US005224883A

United States Patent [19]

Yamamoto

[11] Patent Number: 5,224,883

[45] Date of Patent: Jul. 6, 1993

[54] ELECTRIC CONNECTOR

[75] Inventor: Masayuki Yamamoto, Shizuoka, Japan

[73] Assignee: Yazaki Corporation, Tokyo, Japan

[21] Appl. No.: 850,119

[22] Filed: Mar. 12, 1992

[30] Foreign Application Priority Data

Mar. 14, 1991 [JP] Japan ..... 3-49561

[51] Int. Cl.[5] ..... H01R 13/436

[52] U.S. Cl. ..... 439/752; 439/595

[58] Field of Search ..... 439/595, 752

[56] References Cited

U.S. PATENT DOCUMENTS 4,921,448 5/1990 Endo et al. ..... 439/595
4,946,398 8/1990 Takenouchi et al. ..... 439/595
5,108,319 4/1992 Tsuji et al. ..... 439/595

FOREIGN PATENT DOCUMENTS 183978 7/1990 Japan ..... 439/752
1-43986 9/1992 Japan .

*Primary Examiner*—Gary F. Paumen
*Attorney, Agent, or Firm*—Krass & Young

[57] ABSTRACT

The electric connector of this invention comprises: a housing containing an array of terminal accommodating chambers for receiving terminals; and a rear holder having openings that correspond to rear openings of the terminal accommodating chambers, the rear holder being fitted between side walls formed at the rear of the housing.

The housing and the rear holder include means which provisionally lock the rear holder when the rear holder is inserted into the rear portion of the housing to the position where its front surface comes into contact with the rear surface of the housing and the corresponding openings of the rear holder and the housing virtually align with each other. The housing and the rear holder also include means which, when the rear holder is slid from the provisional engagement position to the final assembly position in constant surface contact with the housing, fully locks the rear holder at this final assembly position.

Since the rear holder in the provisional engagement position and the housing are in surface contact, with no gap between them and with the corresponding openings virtually aligned, the terminal can be smoothly inserted and the rear holder can be slid to the full engagement position in a single-step procedure.

4 Claims, 6 Drawing Sheets

ELECTRIC CONNECTOR

BACKGROUND OF THE INVENTION

1.Field of the Invention

This invention relates to an electric connector and more specifically to an improvement in an electric connector which has a rear holder to prevent terminals installed in terminal accommodating chambers in the housing from slipping off from the rear of the housing.

2. Description of the Prior Art

Between the terminal and the terminal accommodating chamber is usually provided a locking means called a terminal lance or case lance to prevent the terminal from slipping off from the rear of the housing. The terminal lance is a lance cut and raised from the terminal and adapted to engage with an engagement groove formed in the terminal accommodating chamber's inner wall. The case lance is a resilient engagement arm provided to the accommodating chamber's inner wall to engage with a shoulder or engagement hole in the terminal.

As the connector has an increasing number of terminals and the terminal size decreases, the raised lance and the resilient engagement arm also become smaller, making it difficult to provide a sufficient strength and retaining force. In recent years, a method has come into use which uses a combination of the above-mentioned engagement means and a rear holder, separate from the housing, to bolster the terminal retaining force and improve the reliability of the electric connection. FIGS. 8A and 8B show one example of a conventional electric connector having a rear holder (Japan Patent Publication No. Heisei 1-43986), with FIG. 8A illustrating the rear holder b provisionally engaged with the housing a and FIG. 8B showing it fully engaged.

In the provisional engagement condition of the electric connector of FIG. 8, the terminals c are inserted into terminal accommodating holes $a_1$ until engagement pieces $c_1$ engage with terminal engagement claws a2 to provide a preliminary locking between the terminals and the housing. Then the rear holder b is moved to a full engagement position to securely lock the terminals c by an edge portion $b_1$ of the holder.

SUMMARY OF THE INVENTION

In the provisional engagement condition, since the electric connector of FIG. 8 has a space or gap v between the housing a and the rear holder b, the terminal c is easily caught in the gap and cannot be inserted smoothly. To prevent the rear holder b from being thrust inadvertently to the full engagement position when it is to be mounted on the housing at the provisional engagement position, it is necessary to provide an abut portion (or step) $b_2$ to the inside of the holder. In moving the rear holder b to the full engagement position, this construction requires the holder to be pushed first in the direction of arrow p and then arrow q. That is, it must be shifted downward before being pushed forward, requiring a two-step manipulation for full assembly.

This invention has been accomplished to overcome the above drawback experienced with the conventional art and is intended to provide an electric connector which does not form a gap between it and the rear holder in the provisional engagement condition, which enables smooth insertion of terminals and which permits the holder to be moved to the full engagement condition in a single-step procedure.

To achieve the above objective, the electric connector of this invention comprises: a housing having an array of multiple terminal accommodating chambers for receiving terminals; a rear holder having openings that correspond to rear openings of the terminal accommodating chambers, said rear holder being adapted to be axially fitted to the rear of the housing; a means provided between said housing and said rear holder, said means being adapted to provisionally lock the rear holder when the rear holder is fitted axially to the housing to the provisional engagement position where the front surface of the rear holder comes into contact with the rear surface of the housing and where the corresponding openings of the rear holder and the housing are aligned with each other; and a means provided between said housing and said rear holder, said means being adapted to fully lock the rear holder in a final assembly position when the rear holder is slid, while in surface contact with the housing, from the provisional engagement position to the final assembly position.

In the electric connector of this invention, when the rear holder is provisionally engaged with the housing, they are in surface contact with each other and their corresponding openings are virtually aligned. This assures smooth insertion of the terminals without any hindrance due to steps or gaps, preventing the front end of the terminals from becoming bent. The shifting of the rear holder from the provisional engagement position to the full engagement position is done in a single-step procedure by simply sliding it in one direction, which reduces the number of assembly work processes and improves productivity.

DETAILED DESCRIPTION OF PREFERRED EMBODIMENT

Figure 1:
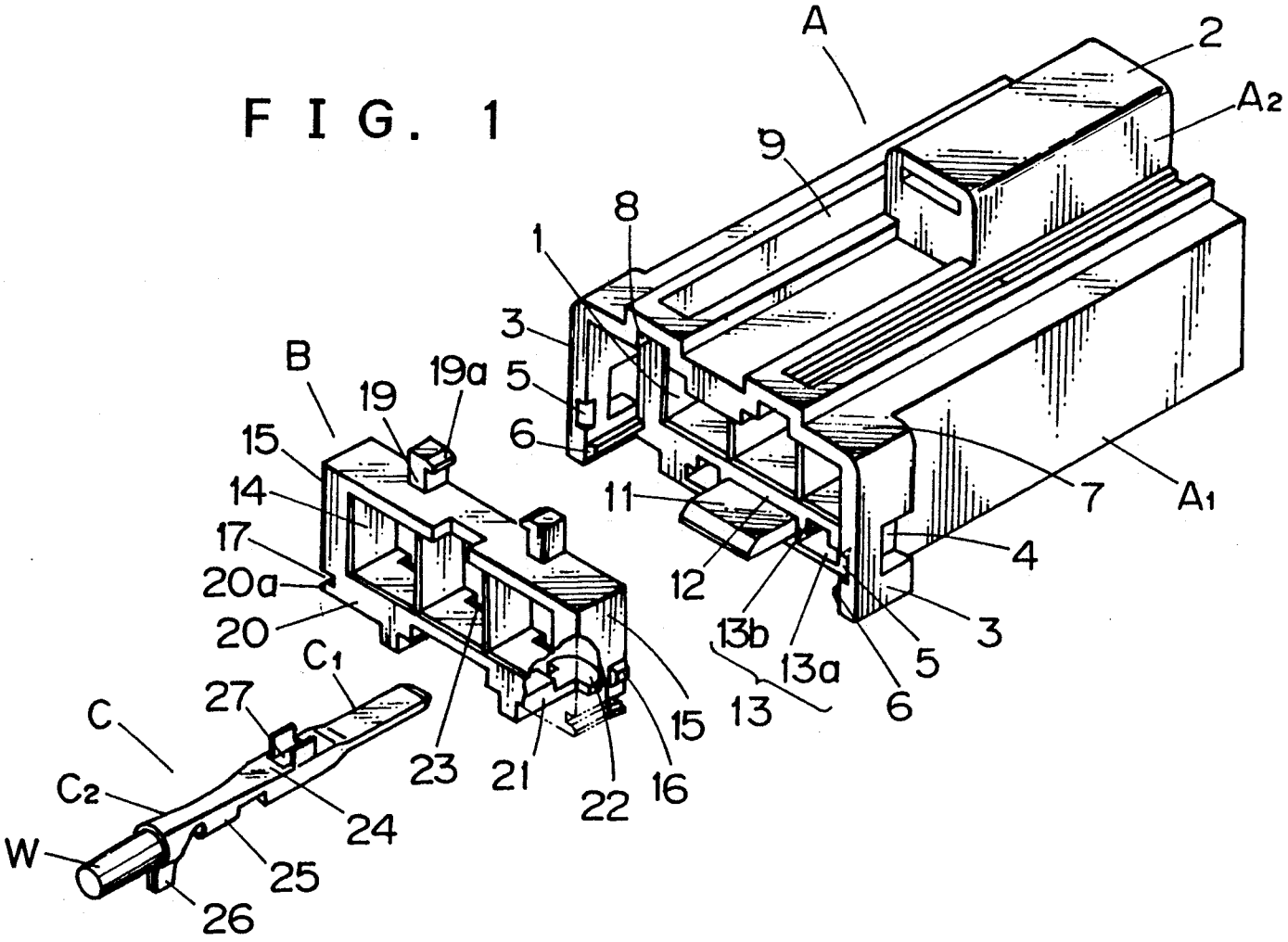
FIG. 1 is a perspective view of one embodiment of an electric connector according to this invention in a disassembled condition.

Referring to FIGS. 1 through 4, reference symbol A represents a female connector housing of synthetic resin; B a rear holder of synthetic resin; and C a male terminal connected to the end of a wire. The housing 4 consists of a housing body $A_1$ having an array of multiple terminal accommodating chambers 1 to accommodate the male terminals C and a hood $A_2$ formed at the front of the housing A to receive a male connector housing (not shown). In the upper circumferential wall of the hood $A_2$ is formed a lock chamber 2 to receive a lock arm (not shown) of the male connector housing. The housing body $A_1$ has side walls 3 extending on both sides of its rear to receive and lock the rear holder B.

Figure 7:
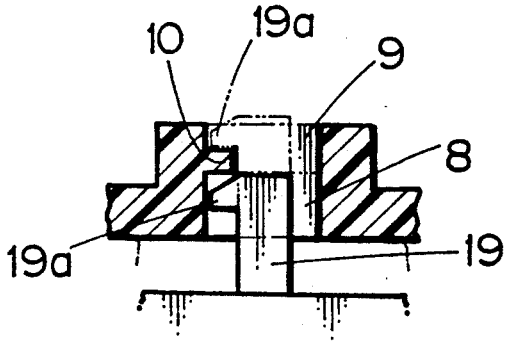
FIG. 7 is a partly enlarged cross section showing an engagement rod 19 of FIG. 5A in a provisional engagement condition.
Figure 8A:
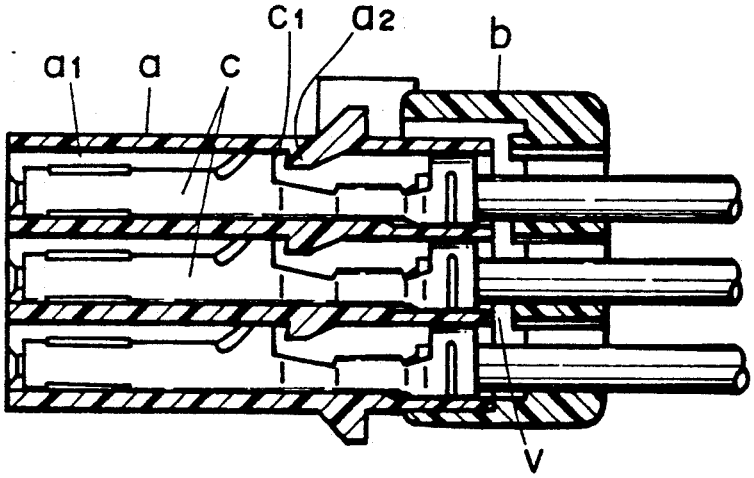
FIGS. 8A and 8B are cross sections showing a conventional electric connector in a provisional engagement condition and in a full engagement condition, respectively.
Figure 8B:
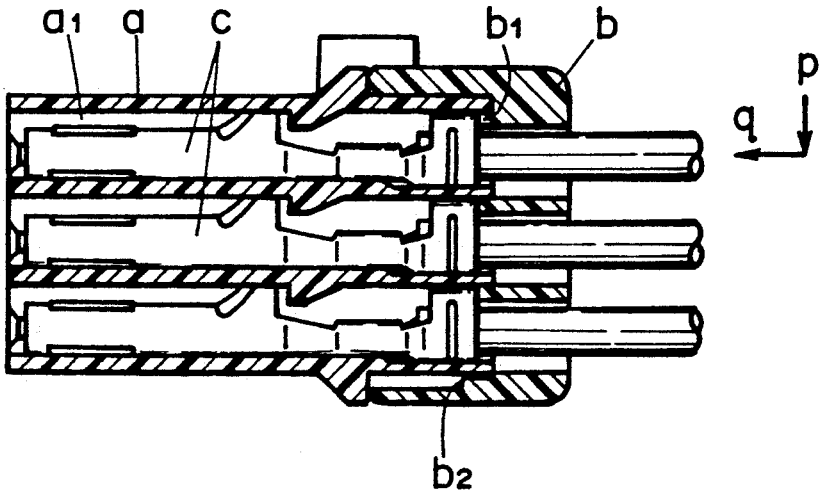

On the rear side of the housing body $A_1$, the side walls 3 have engagement holes 4 formed in the front intermediate portions thereof. On the inner surfaces of the side walls 3 are formed guide grooves 5 behind the engagement holes 4 and also holder engagement projections 6, these being aligned parallel to the direction of terminal insertion. The holder engagement projection 6 are situated below the guide grooves 5, i.e., on the free end side of the side walls 3. The upper parts of the side walls 3, 3 are connected by an upper wall 7, which has two raised strips to form engagement recesses 8. Each of the engagement recesses 8 is provided with an engagement hole 9 and a provisional engagement projection 10 (see FIG. 7). Further, on the rear side the housing body $A_1$ has a guide tongue 11 projecting rearwardly from the lower center thereof and also has an engagement plate 12 extending downwardly. The engagement plate 12 has formed on each side an engagement hole 13 shaped like an inverted T. Each engagement hole 13 consists of a lateral hole portion 13*a* and a narrower vertical hole portion 13*b* that communicates with the former.

The rear holder B is a plate-like member having a plurality of openings 14 that correspond to the terminal accommodating chambers 1 in the housing A. The openings 14 need only be large enough to allow insertion of the male terminals C when the rear holder B is in the provisional engagement position, and thus may be made smaller in cross section than the terminal accommodating chambers 1. The rear holder B has formed on each of its outer side surfaces 15 an engagement projection 16 for mating with engagement holes 4. Rear holder B also includes grooves 17 for sliding engagement with holder engagement projections 6.

Figure 4A:
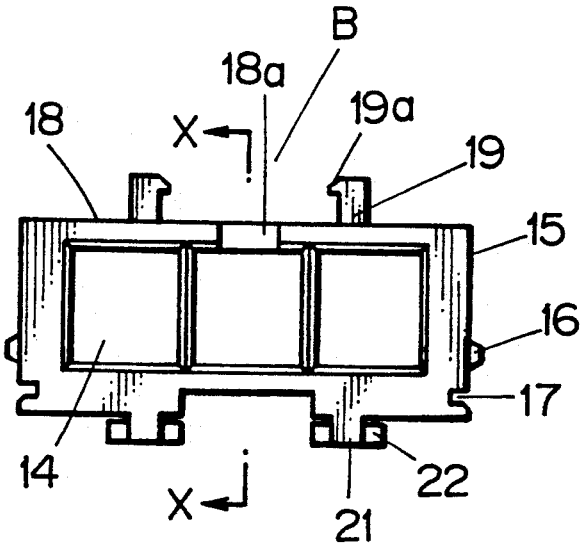
FIG. 4A is a front view of a rear holder of FIG. 1.
Figure 4B:
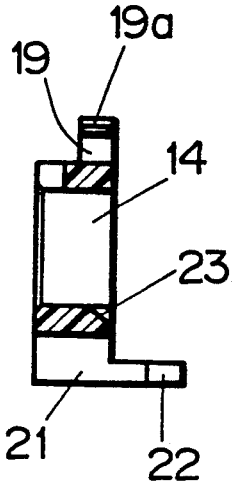
FIG. 4B is a cross section taken along the line X—X of FIG. 4A.

The rear holder B has two engagement rods 19 projecting upward from the upper surface 18 thereof which engage with the engagement recesses 8. On the lower surface 20, the rear holder B has rotation prevention pieces 22 projecting forwardly on L-shaped arms 21 toward the housing A. The two engagement rods 19 engage the engagement recesses 8 and at their upper free end have inwardly bent engagement claws 19*a* . The rotation prevention pieces 22 are so sized that they snugly fit into the lateral hole portion 13*a* of the engagement hole 13. As shown in FIG. 4B, each of the openings 14 in the rear holder B is formed with a tapered thrust engagement surface 23 on one side of the inner edge portion. The thrust engagement surface 23, as described later, is to correct incomplete insertion of the terminal. The engagement holes 4 in the housing body $A_1$ that engage with the engagement projections 16 of the rear holder B are preferably positioned such that, when the rear holder B is moved from the provisional engagement position to the full engagement position, the upper edges 4*a* of the engagement holes 4 abut against the engagement projections 16, thus serving as a stop.

The male terminal consists of a body portion 24 made of a conductive metal plate and bent into a square cylinder, an electric contact portion $C_1$ at the front of the body portion 24, and a wire connecting portion $C_2$ at the rear, these portions being formed in one piece. The electric contact portion $C_1$ is formed as a two-layer folded tab. The wire connecting portion $C_2$ has a pair of conductor clamping pieces 25 and a pair of insulator clamping pieces 26. The body portion 24 has an engagement hole 27 formed in the bottom plate portion thereof. The male terminal C may be provided with a stabilizer (not shown) behind the insulation clamping pieces 26.

With the connector of the above construction, the rear holder B is fitted to the back of the housing A in a provisional engagement state. Then the male terminal C is inserted into the terminal accommodating chamber 1, after which the rear holder B is pushed to the full engagement condition in which the terminal C is prevented from slipping off rearwardly from the housing.

Figure 2:
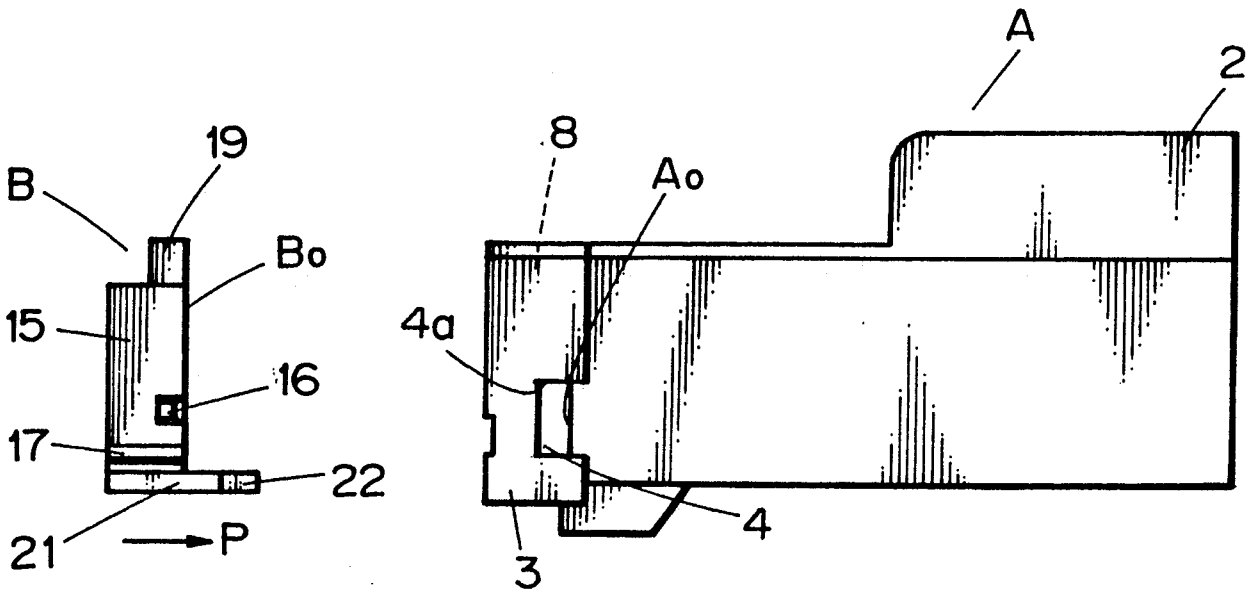
FIG. 2 is a side view of FIG. 1.
Figure 3:
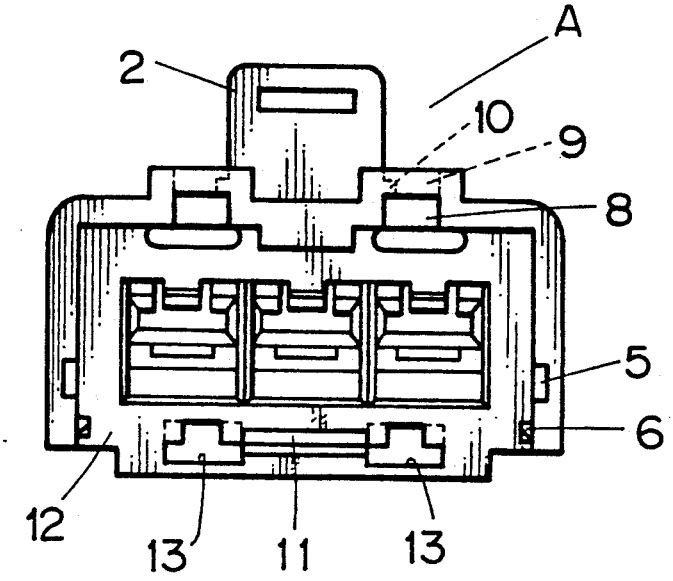
FIG. 3 is a rear view of a female connector housing of FIG. 1.

In FIG. 2, the rear holder B is inserted in the direction of arrow P between the side walls 3, 3 at the rear of the housing A. As the rear holder B advances into the housing A, its engagement projections 16 and engagement grooves 17 are guided by the guide grooves 5 and holder engagement projections 6 on the side walls 3 of the housing A. At this time, the underside 20 of the rear holder B is supported by the guide tongue 11, the two engagement rods 19 enter the engagement recesses 8, and the rotation prevention pieces 22 fit into the lateral hole portions 13*a* of the engagement holes 13.

Figure 6A:
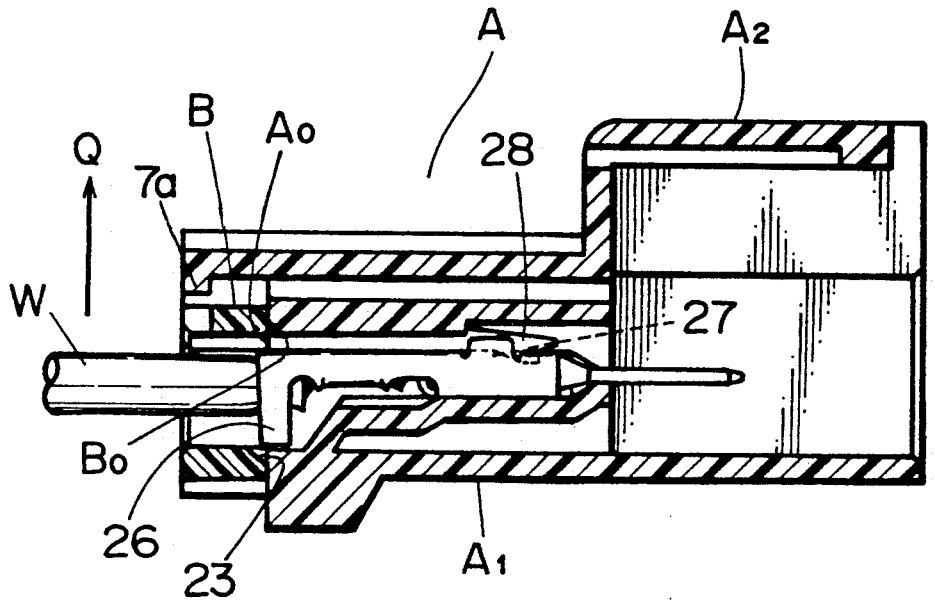
FIG. 6A and 6B are cross sections of the electric connector showing only essential portions, with the rear holder in a provisional engagement condition and in a full engagement condition, respectively, as in the case of FIG. 5.

When the front surface $B_0$ of the rear holder B comes into contact with the rear surface $A_0$ of the housing A as shown in FIG. 6A, the engagement projections 16 engage with the engagement holes 4 to lock the rear holder B in the provisional engagement state, thus preventing it from coming off backwardly. In this provisional engagement position, the rear holder B is prevented from moving loosely in a vertical direction by the engagement between the holder engagement projections 6 and the engagement grooves 17 as well as by the engagement between the engagement claws 19*a* of the engagement rods 19 and the provisional engagement projections 10 in the engagement recesses 8, thus aligning the openings 14 of the rear holder B with the axes of the terminal accommodating chambers 1. With the guide tongue 11 provided as shown, it is possible to eliminate more reliably the play of the rear holder B, particularly in a downward direction.

With the rear holder B in the provisional engagement position, the male terminal C connected to the wire W is inserted through the opening 14 into the terminal accommodating chamber 1, as shown in FIG. 6A. In the terminal accommodating chamber 1 there is provided a resilient locking arm 28 that engages with the engagement hole 27 in the male terminal C to prevent it from coming off backwardly. Hence, when it is fully inserted, the male terminal C is locked by the arm 28, a primary lock.

After the male terminal C is inserted and locked, the rear holder B is slid in the direction of arrow Q in FIG. 6A. As the rear holder 8 is thrust forcibly upward with the front surface $B_o$ of the rear holder B and the rear surface $A_o$ of the housing A in contact, the engagement grooves 17 disengage from the holder engagement projections 6, allowing the rear holder B to move up. As a result, the engagement claws 19*a* of the engagement rods 19 ride over the provisional engagement projections 10 in the engagement recesses 8 to enter the engagement holes 0, bringing the rear holder B into the full engagement condition, in which the corner portions 20*a* at the underside 20 of the rear holder B are supported by the holder engagement projections 6 on the inner surface of the side walls 3.

Figure 5A:
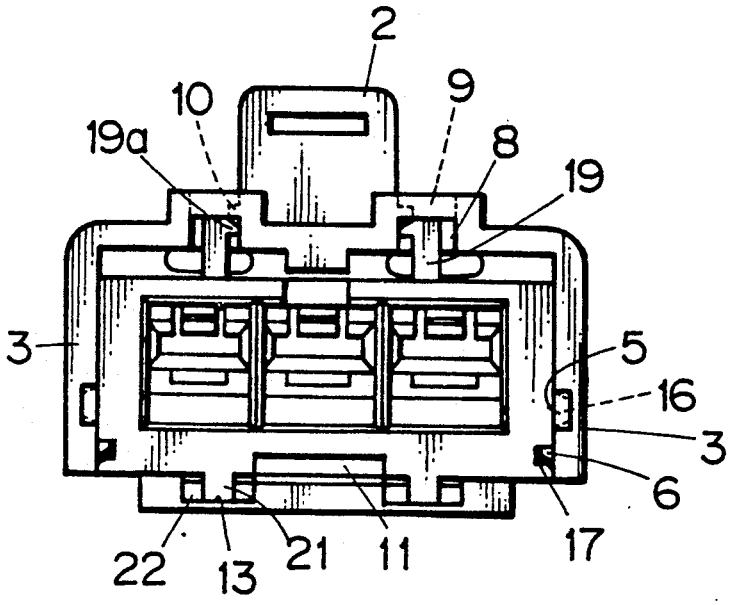
FIG. 5B are rear views of the female connector housing in a provisionally engaged condition and in a fully engaged connection, respectively.
Figure 5B:
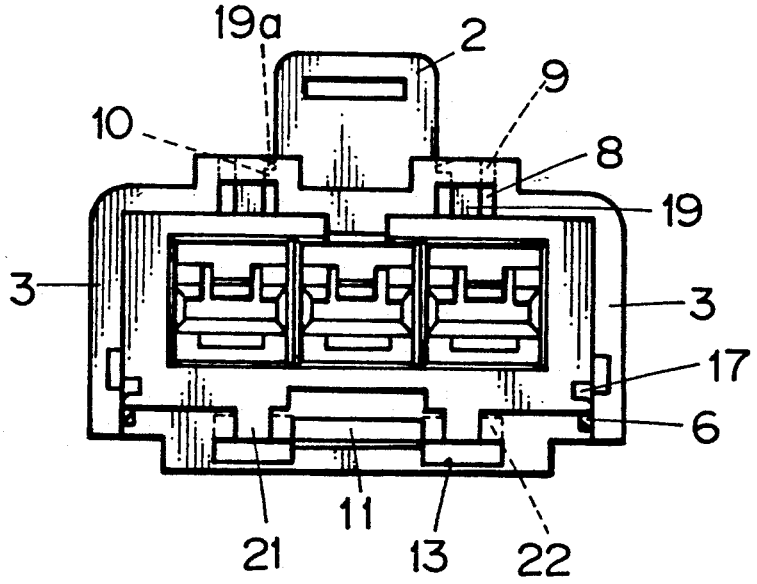
Figure 6B:
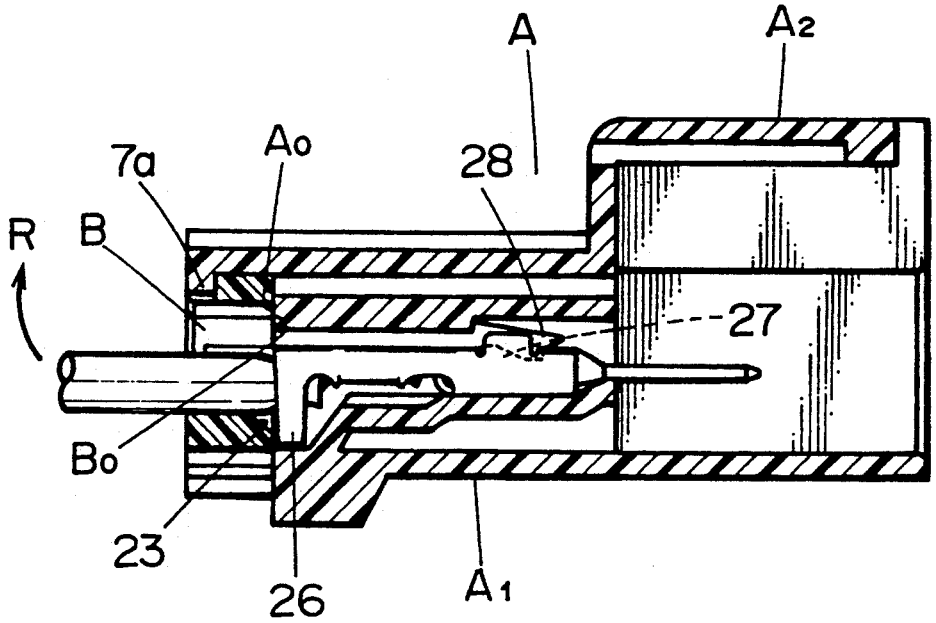

FIG. 5B and 6B both show the rear holder B in the full engagement condition. In this condition, firm engagement is established between the engagement projections 16 and the engagement holes 4, between the engagement claws 19*a* of the engagement rods 19 and the engagement holes 9, between the rotation prevention pieces 22 and the vertical hole portions 13*b* of the engagement holes 13, and between the inner edge portion 7*a* of the upper wall 7 and the central recessed portion 18*a* in the upper surface 18 of the rear holder B. These engagements combine to reliably prevent the rear holder B from coming off backwardly.

In the full engagement condition, when the male terminal C is tensed through the wire W, the rear holder B works as a stopper against the rear portion of the male terminal C (in the example shown, the insulation clamping pieces 26) and, in cooperation with the above-mentioned primary lock, reliably prevents the backward slip-off of the terminal. If there are any incompletely inserted male terminals C when the rear holder B is slid from the provisional engagement position to the full engagement position, the tapered thrust engagement surfaces 23 in the openings 14 engage with the insulator clamping pieces 26 of the inadequately inserted terminals C, thrusting them forwardly into the terminal accommodating chambers 1. This eliminates the incomplete insertion as the rear holder B is moved to the full engagement position.

In FIG. 6B, when the rear holder B is subjected to rotary force acting, for example, in the direction of arrow R by the tension of the wire W, there is no possibility of the full engagement condition being broken because the rotation prevention pieces 22 cannot be withdrawn through the vertical hole portion 13*b* with which they are aligned.

While the above description concerns a construction in which the terminal accommodating chambers 1 in the housing A are arranged in a single row, this invention can also be applied to the connector having multiple rows of terminal accommodating chambers. In that case, the openings 14 in the rear holder B need be arranged according to the row-column configuration of the terminal accommodating chambers 1. Since the rear holder B is independent of the locking means provided between the male terminal C and the terminal accommodating chamber 1, i.e., it is separated from the resilient locking arm 28 of the conventional case lance type, it can similarly be applied to the connector of the terminal lance type. The rear holder is also applicable to male connector housings containing female terminals.

As explained above, since the rear holder in the provisional engagement position is in surface contact with the housing, there is no gap between them and the corresponding openings of the rear holder and the housing are aligned, the terminal can be smoothly inserted without being hindered by step or gap during assembly work. Furthermore, the rear holder can be moved to the full engagement position by a single-step procedure. Where a primary locking means is provided between the terminal accommodating chamber and the terminal, the rear holder provides a second lock to the terminal.

What is claimed is:

1. An electric connector comprising:

a housing having an array of multiple terminal accommodating chambers for receiving terminals, the terminal accommodating chambers opening onto a rear surface of the housing;

a rear holder having a front surface provided with openings corresponding to the rear surface openings of the terminal accommodating chambers, said rear holder being adapted to be fitted axially to the rear of the housing;

provisional lock means provided on said housing and said rear holder, said means being adapted to provisionally lock the rear holder when the rear holder is fitted axially to the housing to a position where the front surface of the rear holder is in surface contact with the rear surface of the housing such that the corresponding openings of the rear holder and the housing are aligned with each other with no gap between them; and full lock means provided on said housing and said rear holder, said means being adapted to fully lock the rear holder in a final assembly position when the rear holder is slid in a direction perpendicular to the axial fitting direction of the housing and rear holder with its front surface in constant contact with the rear surface of the housing from the provisional lock position to the final assembly position.

2. An electric connector according to claim 1, wherein said housing (A) has at a rear portion thereof a pair of side walls (3) and an upper wall (7) connecting said pair of side walls so that the side walls and upper wall surround said rear openings of the housing, said rear holder (B) having a pair of side surfaces (15) and an upper surface (18) connecting said pair of side surfaces.

3. An electric connector according to claim 2, wherein said provisional lock means includes an engagement projection (16) formed on each side surface (15) of the rear holder (B) and a guide and engagement structure (4 and 5) formed in each side wall (3) of said housing to receive and lock said engagement projection (16) therein, and full lock means including a pair of engagement rods (19) formed on said upper surface (18) of the rear holder (B) and engagement holes (9) formed in said upper wall (7) of said housing to latch said engagement rods therein.

4. An electric connector according to claim 3, wherein said rear holder has a plurality of openings (14) corresponding to the rear openings of the terminal accommodating chambers in the housing, each opening (14) being formed with a tapered thrust engagement surface (23) on an inner edge portion thereof to contact an incompletely inserted terminal from behind and correct said incomplete insertion when said rear holder is in the final assembly position.

* * * * *

UNITED STATES PATENT AND TRADEMARK OFFICE

CERTIFICATE OF CORRECTION

PATENT NO. : 5,224,883

DATED : July 6, 1993

INVENTOR(S) : Yamamoto

It is certified that error appears in the above-identified patent and that said Letters Patent is hereby corrected as shown below:

Column 2, line 46, delete "FIG. 5B" and insert --FIGS. 5A and 5B--;

Column 2, line 67, delete "housing 4" and insert --housing A--;

Column 3, line 59, delete "engage with the" and insert --engage the--;

Column 3, line 60, delete "the rear" and insert --rear--;

Column 3, line 66, delete "terminal consists" and insert --terminal C consists--;

Column 4, line 59, delete "holder 8" and insert --holder B--;

Column 4, line 67, delete "0," and insert --9,--.

Signed and Sealed this

Nineteenth Day of April, 1994

*Attest:*

*Attesting Officer*

Bruce Lehman

BRUCE LEHMAN

*Commissioner of Patents and Trademarks*